United States Patent [19]

Horton et al.

[11] Patent Number: 5,077,560

[45] Date of Patent: Dec. 31, 1991

[54] AUTOMATIC DRIVE FOR A TVRO ANTENNA

[75] Inventors: Edwin T. Horton, Ballwin, Mo.; Edward W. Smith, Lake Arrowhead; James D. Moore, Torrance, both of Calif.

[73] Assignee: STS Enterprises, Inc., St. Louis, Mo.

[21] Appl. No.: 831,152

[22] Filed: Feb. 19, 1986

[51] Int. Cl.[5] ..... H01Q 3/00

[52] U.S. Cl. ..... 342/359; 343/757; 343/766

[58] Field of Search ..... 342/359, 352, 354, 356, 342/75; 455/12, 25, 170, 151, 160, 179, 185, 186; 343/754, 757, 766, 878, 880, 882, 763

[56] References Cited

U.S. PATENT DOCUMENTS

| | | | |
|---|---|---|---|
| 3,202,015 | 8/1965 | Moul, Jr. et al. . | |
| 3,546,704 | 12/1970 | Selby et al. . | |
| 3,787,870 | 6/1974 | Rocci . | |
| 3,793,634 | 2/1974 | Heller et al. . | |
| 3,842,420 | 10/1974 | Rabow . | |
| 3,945,015 | 3/1976 | Gueguen . | |
| 4,030,099 | 6/1977 | Valenti et al. | 342/75 |
| 4,148,026 | 4/1979 | Gendreu . | |
| 4,156,241 | 5/1979 | Mobley et al. . | |
| 4,204,214 | 5/1980 | Fassnacht . | |
| 4,224,507 | 9/1980 | Gendreu . | |
| 4,232,320 | 11/1980 | Savalle, Jr. . | |
| 4,251,819 | 2/1981 | Vickland . | |
| 4,295,621 | 10/1981 | Siryj . | |
| 4,305,075 | 12/1981 | Salvat et al. . | |
| 4,338,607 | 7/1982 | Drabowitch . | |
| 4,352,202 | 9/1982 | Carney | 342/359 |
| 4,355,313 | 10/1982 | Hubert . | |
| 4,418,350 | 11/1983 | Rosen . | |
| 4,491,388 | 1/1985 | Wood . | |
| 4,491,847 | 1/1985 | Estang . | |
| 4,538,175 | 8/1985 | Balbes et al. | 455/12 |
| 4,602,259 | 7/1986 | Shepard | 342/359 |
| 4,626,864 | 12/1986 | Micklethwaite | 343/766 |
| 4,691,207 | 9/1987 | Timineri | 342/359 |
| 4,707,699 | 11/1987 | Toellner et al. | 342/352 |

*Primary Examiner*—Gregory C. Issing

*Attorney, Agent, or Firm*—Rogers, Howell, Moore & Haferkamp

[57] ABSTRACT

A receiver and antenna drive gear unit provide optimal mechanical and electrical pointing of the antenna dish at each of the satellite orbiting in geo-synchronous fashion above the equator, the receiver having the capability of calculating and initially pointing the antenna dish at each of the satellites, and then providing peaking routines under operator control to maximize signal strength. The antenna drive gear unit utilizes a separate motor for each of the azimuth and elevational directions and utilizes circular ring gears and a spur gear to drive the antenna, thereby providing much more accurate and repeatable monitoring and positioning of the antenna unit over extended usage.

24 Claims, 3 Drawing Sheets

AUTOMATIC DRIVE FOR A TVRO ANTENNA

BACKGROUND AND SUMMARY OF THE INVENTION

The satellite television reception only (TVRO) industry is presently experiencing an ever-increasing growth in demand for systems to provide the tremendous array of programming available to the consumer. As is well known in the art, there is a band of satellites in geo-synchronous orbit over the equator, and each of these satellites has a number of transponders which transmit an RF signal containing video and audio information for a television program. This information can be received by an antenna comprised of a dish mounted to a support (generally a pole) with the dish being canted with respect to the pole and aligned such that as it is driven from side-to-side it moves its focal axis through the "arc" of satellites. As can be appreciated by those of ordinary skill in the art, the geometry involved can be quite complicated in that the canting of the dish with respect to the pole varies with respect to the geographic location of the dish (commonly referred to as the declination angle) and the alignment of the pole and dish is critical to ensure that movement of the dish in the azimuth direction moves the dish along the arc.

Because of the rapid growth in this market, there are not nearly enough skilled people to attend to the installation of antennas in a proper manner to ensure optimum performance. Furthermore, to the extent that these installers are available, they are in high demand and their time can be quite expensive, thus adding significantly to the cost of an installed TVRO system. Still another problem is that typically a linear actuator, or linear jack, is mounted between the support pole and the dish and is used as the drive mechanism to drive the dish. These linear actuators are no more than jacks which extend and retract in piston-like fashion. As a result of this translation of linear to rotational movement, there is no direct relationship between jack travel and arc degrees through which the dish moves. In other words, one inch of jack travel does not correspond to a given number of degrees of arc movement for the antenna as it depends upon the jack mounting, and the location of its travel at which the measurement is taken. This non-linear relationship makes it somewhat difficult to repeatedly, automatically move between satellites without individually programming in each satellite after the antenna and receiver are installed.

Still another problem experienced in TVRO system installations is that the antenna, being a mechanical structure, has a tendency to shift its adjustment over time due to weathering, and other factors. Therefore, to maintain optimal reception, most antennas should be readjusted periodically to ensure that they remain "on the arc" and that the best available signal is received from each of the satellites. Of course, this readjustment can be expensive but with antennas of the prior art, there is not much choice.

To solve these and other problems with prior art antennas and receivers, the inventors herein have succeeded in developing a receiver and antenna gear drive unit which transforms a complicated timeconsuming installation process into one that can be handled by those inexperienced in the art, such as first time purchasers of TVRO systems. The antenna drive unit includes a first motor and an associated gear train for driving the dish in an azimuth direction, and a second motor with an associated gear train for driving the dish in an elevational direction. With a two-motor drive system, the antenna can be moved and oriented in a much wider range of positions than with the single azimuth drive achieved by the linear actuator of the prior art. Additionally, as the gear units are self-contained and are comprised of substantially circular or spur gears, there is a linear relationship between the movement of the dish and the movement of the motor shafts or any of the associated gears such that the position of the dish can be accurately determined both initially, and as the dish continues to operate over time. It is significant that there are no worm gears in the drive unit. Generally worm gears are used to minimize backlash and slippage in the gears which leads to mispointing of the antenna and a deterioration of the signal and picture displayed. However, worm gears require expensive materials and construction whereas the ring and spur gears of the present design may be made of injection molded plastic. Backlash and gear slippage is minimized through the enormous reduction ratios present in the gearing.

Still another feature of the present invention is the microprocessor based receiver which has means to store the necessary data to correctly calculate and automatically position the antenna at each of the available satellites merely upon an operator's entry of the antenna site location in latitude and longitude. Additionally, automatic peaking routines are available under operator command through the remote control to peak each antenna position for maximum signal strength. This is typically done upon initial installation, and at periodic intervals or when the operator might suspect a shifting has occurred such that there is a deterioration in picture or sound quality. Once these "peaked" positions are obtained automatically, they are stored by the operator and provide the position data to repoint the antenna at each of the satellites during normal day-to-day operation.

Still another feature of the present invention is a peaking program under operator control which eliminates skew by rotating the probe to a signal null and then repositioning the probe 90° away from the null to maximize signal strength. As nulls are much more sharply defined than the peak signal point in the spectrum, physically locating the null point and then rotating 90° from that null point results in a more accurate alignment of the probe to eliminate skew. As is known in the art, skew results from misalignment of the probe with respect to the incoming horizontally or vertically polarized signal. Skew is present at each of the various positions of the antenna as the satellites lie on an arc while the antenna is physically located on a surface well above the focal point of that arc. Therefore movement of the dish from satellite-to-satellite results in a misalignment of the probe with respect to the satellite, thereby requiring skew adjustment.

While the various features of this invention may be separately utilized in connection with other compatible pieces of equipment manufactured by others, the gear drive unit of the present invention permits the receiver to utilize its entire capability by accurately positioning the satellite in the azimuth and elevation direction, as well as to adjust the skew of the probe to absolutely maximize the quality of the picture and sound received from the satellite. This can be important because of the great variation in signal strength from satellite-to-satellite as one moves from point-to-point throughout North America. All satellites have a "footprint" which defines the area of acceptable power within which they can be received. Therefore, to maximize the available programming for any particular geographic location, the additional features and benefits of the present invention maximize the opportunity to receive as much programming as possible.

While the foregoing has been a brief description and summary of some of the principal advantages and features of the present invention, a more complete understanding and appreciation for the invention may be obtained by referring to the drawings and description of the preferred embodiment which follows.

DETAILED DESCRIPTION OF THE PREFERRED EMBODIMENT

Figures 1, 2, 11:
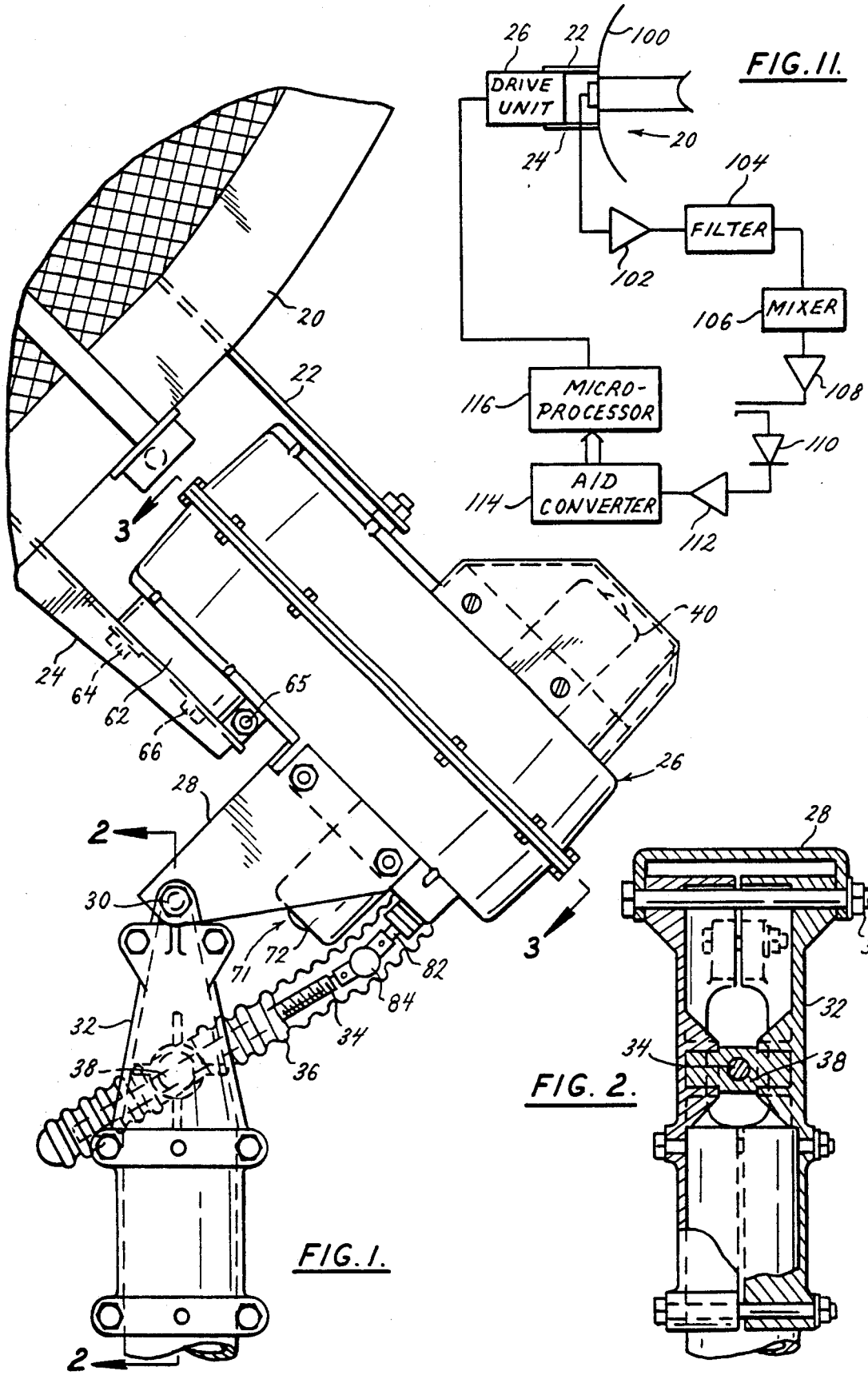
FIG. 1 is a side view of the antenna drive gear unit of the present invention.
FIG. 2 is a partial cross-sectional view taken along the plane of line 2—2 in FIG. 1 detailing the mounting of the elevation rod to the support pole.
FIG. 11 is a schematic diagram of the peaking circuit included in the receiver as connected to the antenna.

As shown in FIG. 1, an antenna dish 20 has a pair of drive brackets 22, 24 extending rearwardly for mounting to the antenna drive gear unit 26 of the present invention. In turn, the antenna drive gear 26 is pivotally mounted through a bracket 28 and mounting bolt assembly 30 to a support post 32. The elevation drive rod 34 is enclosed by a weather protective gasket 36 and extends between the antenna drive gear 26 and a captive nut 38, as best shown in FIG. 2. Thus, as the elevation rod 34 is rotated, it advances within the captive nut 38 to rotate the antenna drive gear 26 about the mounting bolt assembly 30 and support post 32 to change the elevation thereof.

Figure 3:
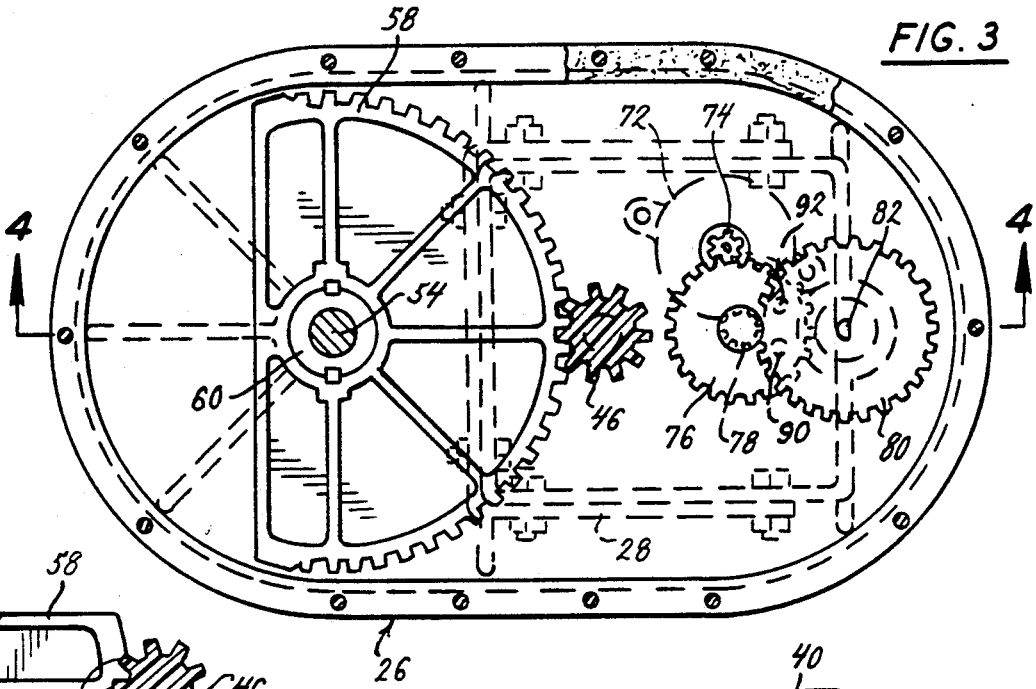
FIG. 3 is a cross-sectional view taken along the plane of line 3—3 in FIG. 1 and detailing the gear trains.
Figure 10:
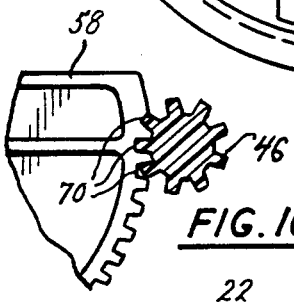
FIG. 10 is an enlarged view of the spur output gear of the azimuth drive detailing the change in teeth size at the limit of its travel.
Figure 4:
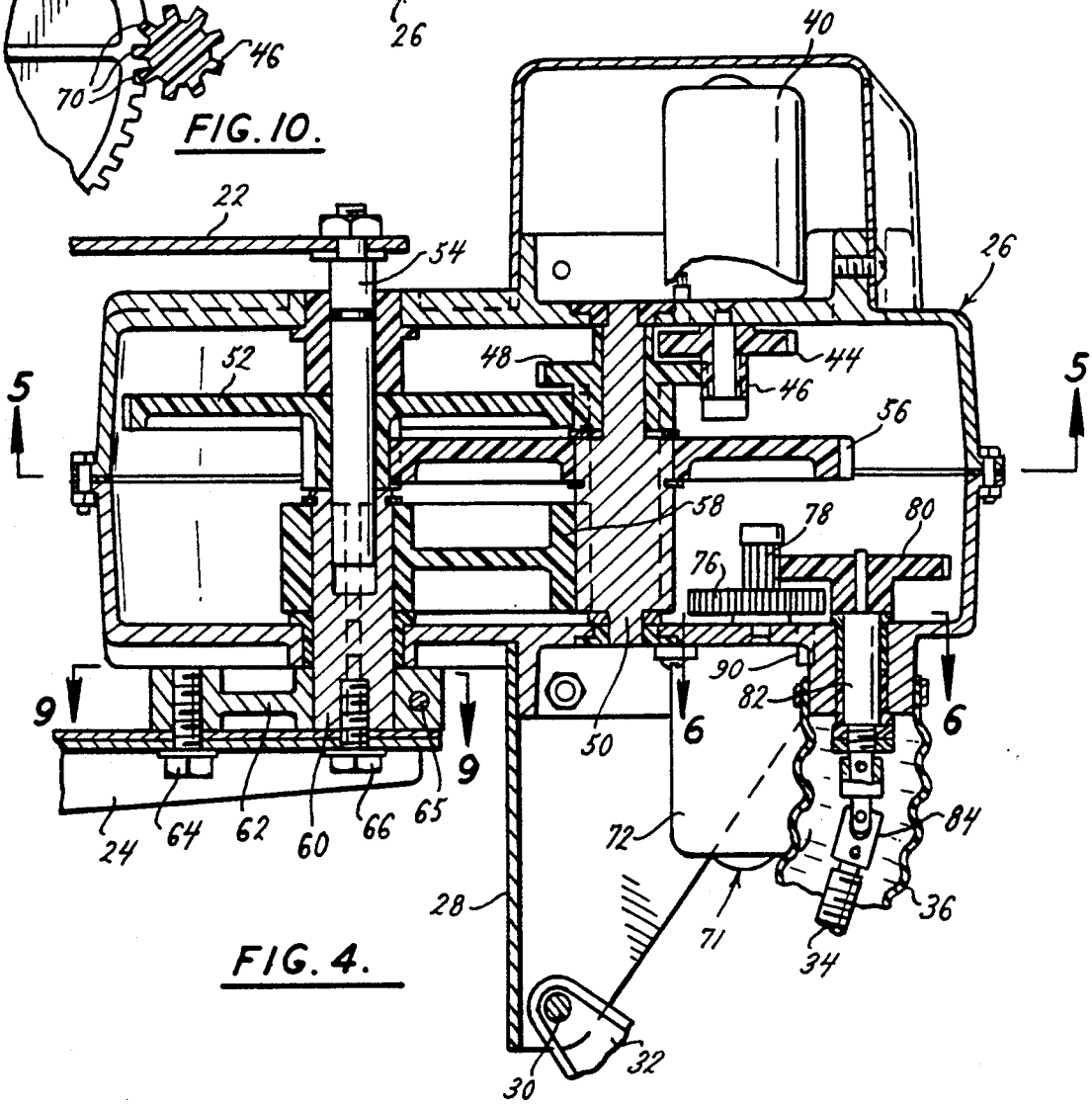
FIG. 4 is a cross-sectional view taken along the plane of line 4—4 in FIG. 3 and further detailing the drive motors, gear trains and shaft mounting.
Figure 5:
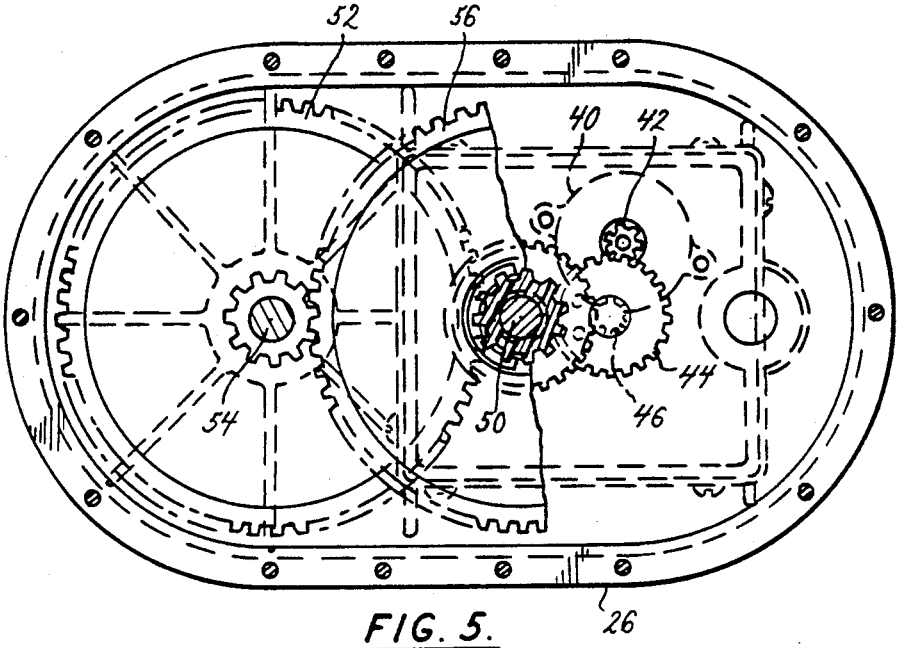
FIG. 5 is a cross-sectional view taken along the plane of line 5—5 in FIG. 4 detailing the azimuth gear train.
Figure 9:
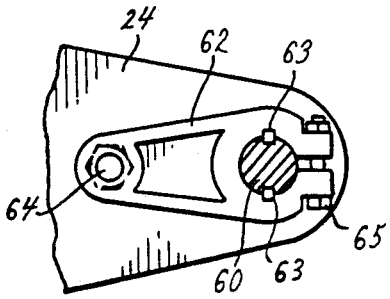
FIG. 9 is a cross-sectional view taken along the plane of line 9—9 in FIG. 4 detailing the adapter mounting of the azimuth output drive shaft to the antenna bracket.

The gearing arrangement for the antenna drive gear 26 is best shown in FIGS. 3–5, and includes an azimuth drive motor 40 having an output gear 42 meshing with circular gear 44. Gear 44 has an extension shaft 46 which meshes with an idler gear 48 slip fit to a first gear shaft 50. Idler gear 48 has teeth meshing with large circular gear 50 slip fit over the azimuth output drive shaft and gear 54. Large circular gear 52 has a hub which meshes with gear 56, gear 56 having a sleeve which meshes with spur gear 58, spur gear 58 being fixed to output shaft 60. An adapter 62 is bolted by bolts 64, 66 to the lower drive bracket 24, and provides a two-point mounting between the drive bracket 24 and the azimuth drive output spur gear 58. Thus, azimuth drive motor 40 has an output shaft which is coupled through a series of reduction gears to drive an azimuth output drive shaft through a spur gear. All of the gears in the drive train are substantially circular, or are spur gears. None of the gearing involves a worm gear, and all of the gears can be manufactured through injection molding processes. As best shown in FIG. 9, the adapter 62 may be pinned by lock pin 63 to the azimuth drive output shaft 60 and rigidly secured with a compression nut assembly 65. As shown in greater detail in FIG. 10, the last several teeth 70 at the end of travel for each side of spur gear 58 are shaped somewhat differently to provide a mechanical lock to physically prevent overtravel of the antenna dish 20 in the azimuth direction. This is merely a safety measure to prevent damage to persons or property should the present invention be improperly installed or operated.

The elevation drive 71 includes an elevation drive motor 72 having an output gear 74 which meshes with circular gear 76, circular gear 76 having an axial extension 78 with teeth meshing with radial gear 80. Circular gear 80 drives output shaft 82 which is connected to elevation rod 34 through a U-joint 84, as best shown in FIG. 4. Thus, the elevation drive 71 includes a drive motor connected through a series of circular gears to an output shaft which rotates to move the antenna drive gear unit (and attached dish) in an elevation direction.

Figure 7:
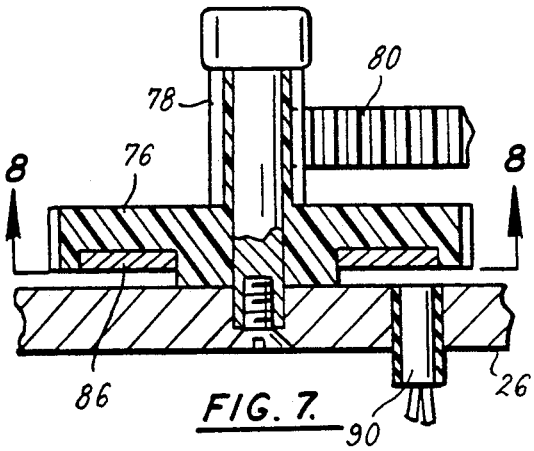
FIG. 7 is a cross-sectional view taken along the plane of line 7—7 in FIG. 6 detailing the mounting of the position detector and magnetic pickup in the elevation drive.
Figure 8:
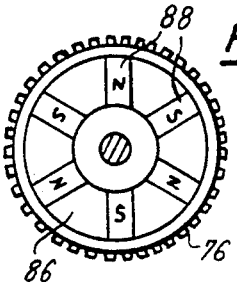
FIG. 8 is a cross-sectional view taken along the plane of line 8—8 in FIG. 7 detailing the detector wheel.
Figure 6:
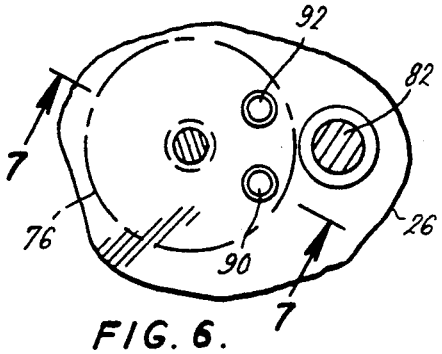
FIG. 6 is a partial cross-sectional view taken along the plane of line 6—6 in FIG. 4 detailing the position detector for the elevation drive.

As best shown in FIGS. 6–8, both drive motors 40, 72 have detectors for detecting the rotational movement of the motors. For purposes of illustration, the detector for the elevation drive 71 is shown although it will be understood by those of ordinary skill in the art that a similar such device is included for the azimuth motor 40. The detector assembly includes a detector wheel 86 which is countersunk within circular gear 76 and which has a plurality of magnets 88 which revolve past two electromagnetic pickups 90, 92 for sensing the varying polarities of the magnets 88. Thus, as the output shaft rotates the circular gear 76, a switch closure is provided in direct proportion to the rotational movement thereof, and the corresponding longitudinal movement of either the elevation, or the arcuate movement of the dish through the azimuth direction. An important feature of the present invention is the use of circular gears in both drives as opposed to the linear actuator of the prior art. With the circular gearing in the present design, there is a direct linear relationship between the movement of the output gearing and the movement of the dish in either the azimuth or the elevational direction. This accurate positioning is highly desirable in precisely positioning and pointing the antenna dish at the proper satellite in a manner which is repeatable in extended operation of the unit. This significantly increases the mechanical accuracy of the system, and significantly reduces the adjustment and installation problems inherent with the linear actuators of the prior art.

As best shown in FIG. 11, an antenna dish 100 has an electrical output which passes through an amplifier stage 102, a filter stage 104, a mixer stage 106, another amplifier stage 108, and its output is then detected for signal strength and passed through diode 110, another stage of amplification 112, and an A/D converter 114 before being input to a microprocessor 116. This microprocessor 116 senses the maximum strength generated by this circuit and produces an output to drive the antenna drive gear unit 26 during the peaking portion of the operation.

Attached as Attachments A, B and C to the specification are flow charts which describe the operation of the remote control unit in connection with the receiver unit and which provide operator control of the peaking steps in the installation and operation of the receiver and antenna drive of the present invention. As shown in Attachment A, the receiver can be used in conjunction with a linear actuator as is found in the prior art to achieve some of the functions available with the decreased amount of positioning capability provided by the prior art mounting and antenna movement systems. With this installation, the elevation and declination of the antenna dish is mechanically set, and the receiver has automatic control and provides operator programmability with respect to the azimuth drive only. While this doe not provide optimum reception, it does provide some of the features which are highly desirable, such as rapid satellite programmability, and automatic calculation of satellite location through entry of antenna geographic positional data.

As shown in Attachment B, the receiver and remote control unit can be used by an operator to program in the geographic location by longitude and latitude of the antenna which permits the receiver to automatically calculate pointing data for the antenna to find each of the available satellites, and also provides operator control of peaking through signal strength seeking and scanning through a defined predetermined arc of movement for maximum signal reception, and then storing that data to provide repeated pointing in accordance with the results.

As shown in Attachment C, the operator may utilize the remote control and receiver to determine the proper position of the probe to maximize signal strength and eliminate skew for each satellite position. This routine achieves peaking by searching for a null, and then rotating the probe 90° away from the null as the null is generally much sharper in the signal spectrum than the maximum signal position.

There are various changes and modifications which may be made to the invention as would be apparent to those skilled in the art. However, these changes or modifications are included in the teaching of the disclosure, and it is intended that the invention be limited only by the scope of the claims appended hereto.

SAT Position Flowchart (Actuator)

IF YOUR SYSTEM IS TO BE INSTALLED USING AN ACTUATOR TYPE DRIVE, THIS FLOW CHART SHOULD BE USED TO POSITION THE ANTENNA. YOU SHOULD REFER TO SAT PARAMETER FLOW CHART BEFORE ENTERING THIS MODE. CHECK TO INSURE YOU HAVE SELECTED THE ACTUATOR TYPE DRIVE. TO ENTER THE SAT POSITION PROGRAMMING MODE, PUSH THE SELECT BUTTON ON THE RECEIVER TWO TIMES. IN THE SAT POSITION PROGRAMMING MODE, THE INSTALLER OR OPERATOR CAN ACCESS FOUR BASIC PROGRAMMING FUNCTIONS. THE NEW SAT SELECT MODE ALLOWS THE OPERATOR TO PROGRAM THE ANTENNA FOR A NEW SATELLITE POSITION OR CHANGE THE ANTENNA POSITION FOR AN EXISTING SATELLITE. THE ALL SAT MODE IS USED TO PROGRAM ALL ANTENNA POSITIONS DURING INITIAL INSTALLATION. THE SAT POSITION AUTO ON ALLOWS AUTOMATIC PEAKING OF THE ANTENNA AFTER INITIAL PROGRAMMING IS COMPLETED. AUTO OFF TURNS OFF AUTO PEAKING FUNCTIONS.

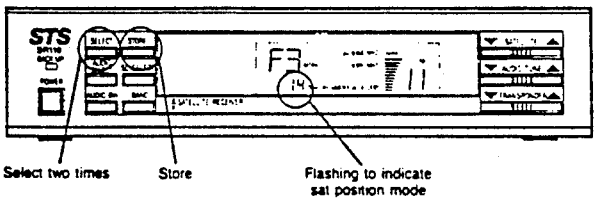

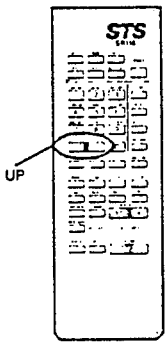

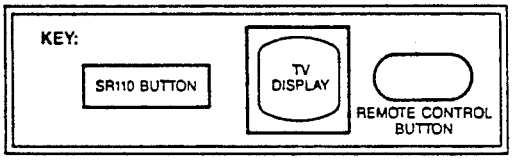

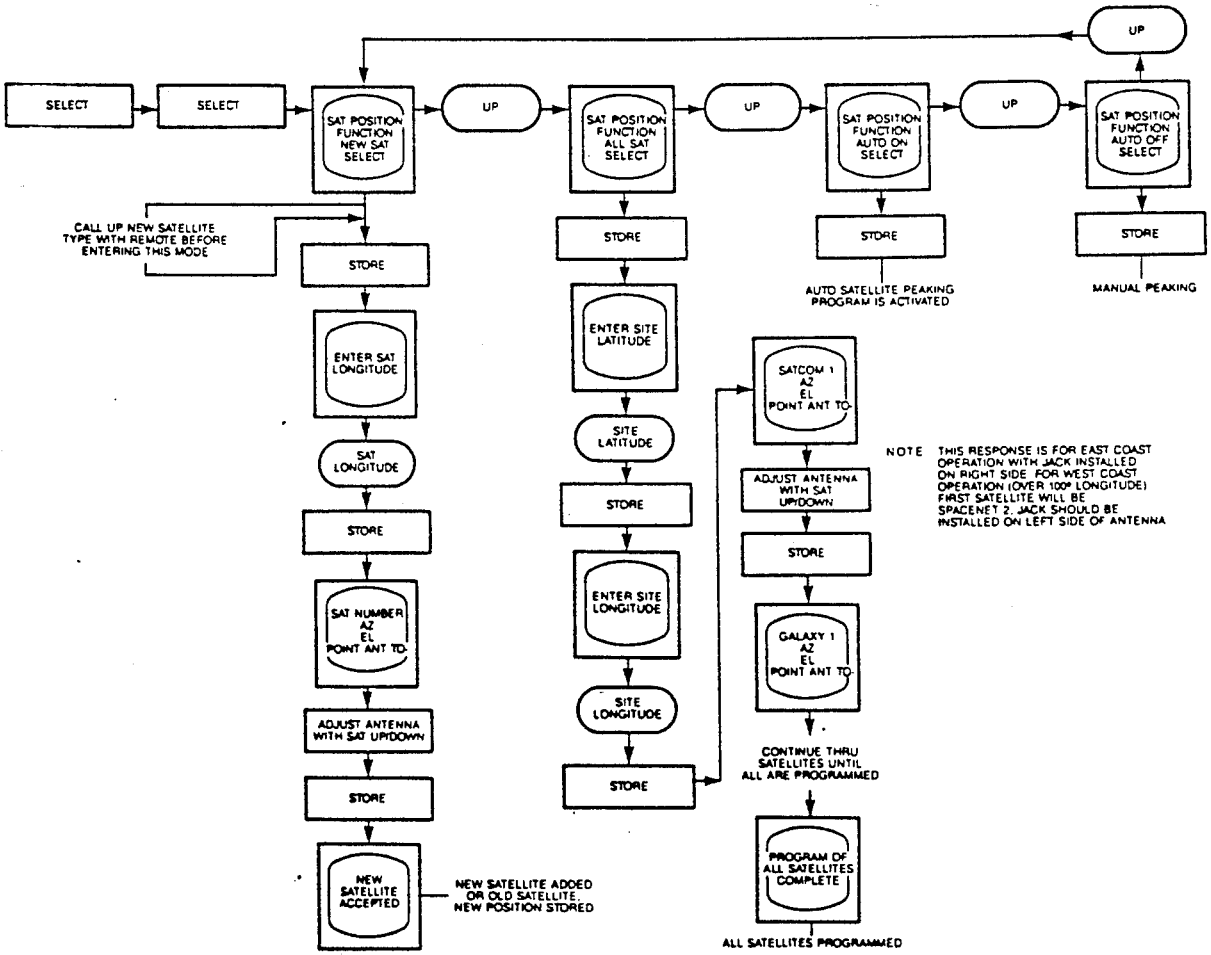

SAT Position Flowchart (Gearbox)

IF YOUR SYSTEM IS TO BE INSTALLED USING THE STS GEARBOX DRIVE, THIS FLOW CHART SHOULD BE USED TO POSITION THE ANTENNA. YOU SHOULD REFER TO THE SAT PARAMETER FLOW CHART BEFORE ENTERING THIS MODE. CHECK TO INSURE THAT YOU HAVE SELECTED THE GEARBOX TYPE DRIVE. TO ENTER THE SAT POSITION PROGRAM MODE, PUSH THE SELECT BUTTON ON THE RECEIVER TWO TIMES. IN THE SAT POSITION PROGRAMMING MODE, THE INSTALLER OR OPERATOR CAN ACCESS FOUR BASIC PROGRAMMING FUNCTIONS. THE NEW SAT SELECT MODE ALLOWS THE OPERATOR TO PROGRAM THE ANTENNA FOR A NEW SATELLITE POSITION OR CHANGE THE ANTENNA POSITION FOR AN EXISTING SATELLITE. THE ALL SAT MODE IS USED TO PROGRAM ALL SATELLITE ANTENNA POSITIONS. DURING INITIAL INSTALLATION, THE SAT POSITION AUTO ON ALLOWS AUTOMATIC PEAKING OF THE ANTENNA DURING INITIAL PROGRAMMING. AUTO OFF TURNS OFF AUTO PEAKING FUNCTION.

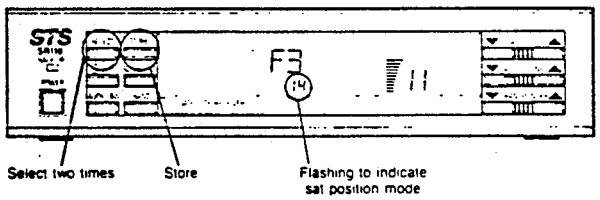

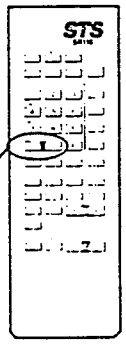

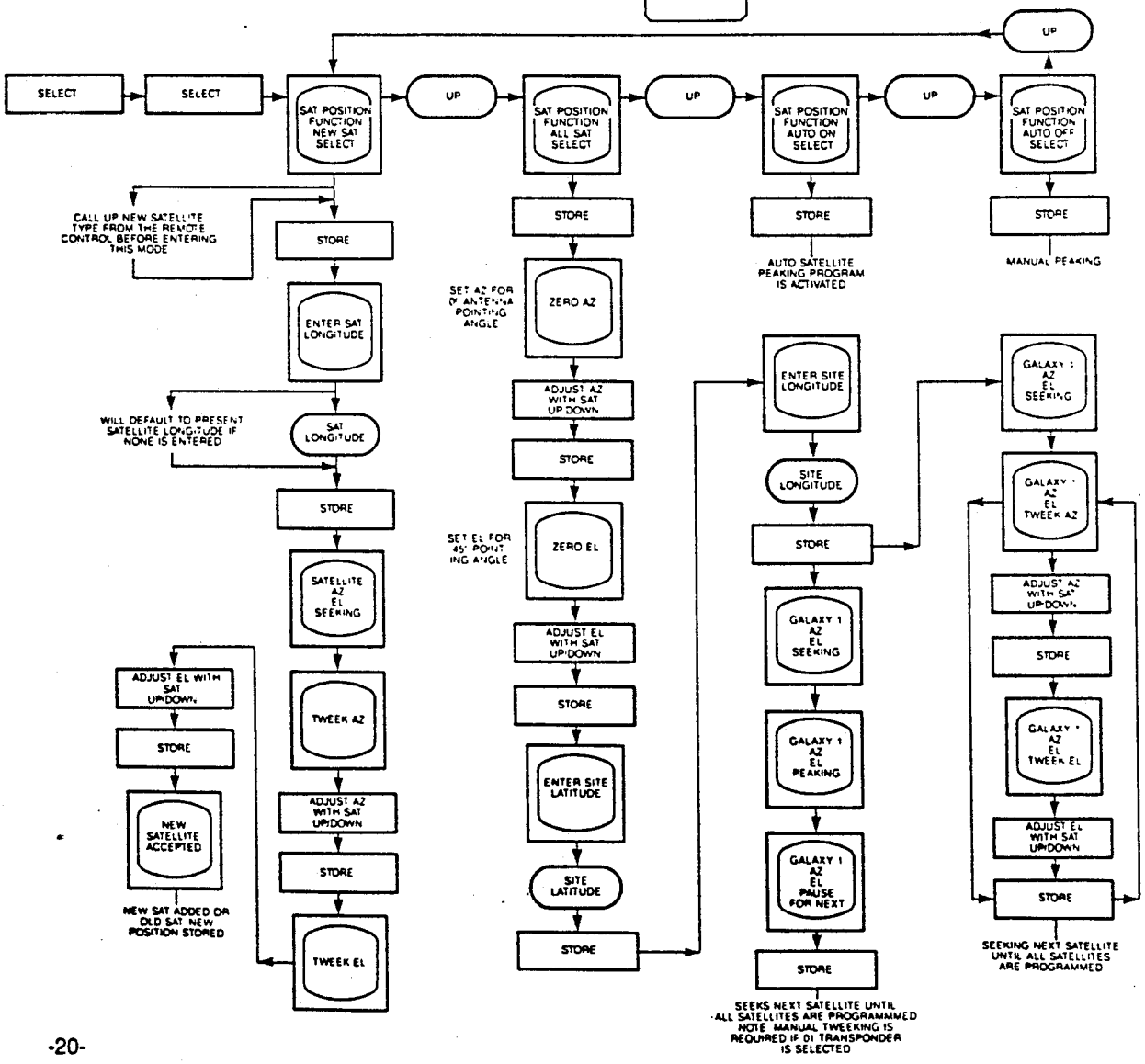

Polarization Flowchart

TO ENTER THE POLARIZATION MODE, PUSH THE SELECT BUTTON ON THE RECEIVER FOUR TIMES. THE POLARIZATION PROGRAMMING MODE ALLOWS THE INSTALLER TO PERFORM FOUR BASIC PROGRAMMING FUNCTIONS. THE SKEW SELECT MODE ALLOWS POSITIONING OF THE POLARIZATION PROBE TO COMPENSATE FOR ANTENNA POSITIONING, BOTH VERTICAL AND HORIZONTAL ARE ADJUSTED EQUALLY. THE ORTHOGONAL MODE IS USED TO ADJUST THE PROBES TO BE 90° FROM EACH OTHER WHEN CHANGING FROM VERTICAL TO HORIZONTAL. THE AUTO ON ENABLES THE AUTOMATIC POLARIZATION PEAKING MODE. AUTO OFF DISABLES THE AUTOMATIC POLARIZATION PEAKING MODE.

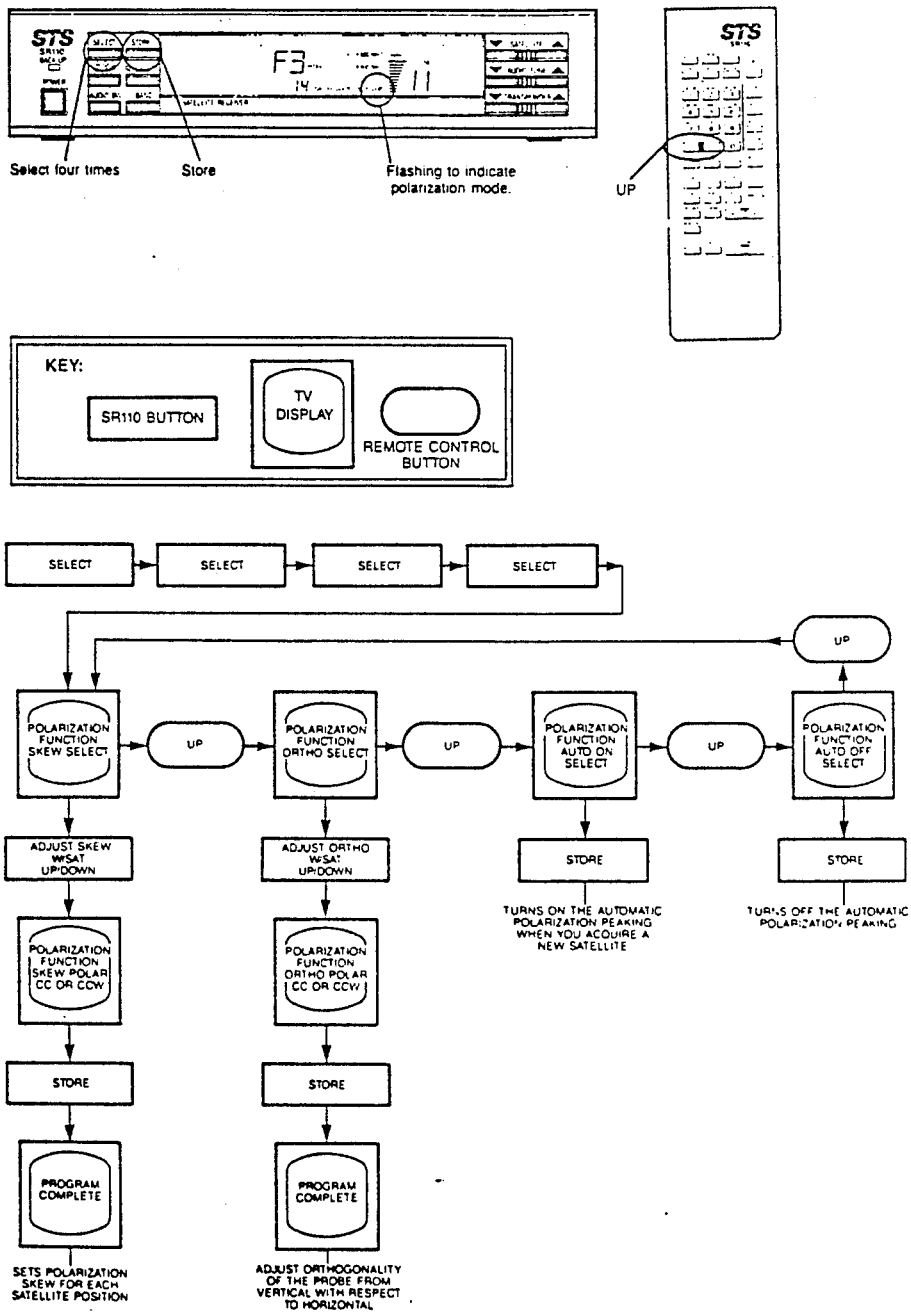

-22-

What is claimed is:

1. A satellite television receiver having means to process signals received by an antenna from a plurality of satellites in geo-synchronous orbits over the equator, the antenna comprising a dish, means mounting the dish to a support, a signal pickup means, and means to drive the dish in the azimuth and elevation directions to point it at one of said satellites, the receiver having means to control the drive means, means for an operator to program the receiver by initializing the antenna and entering data corresponding to the geographic location of the antenna, means to calculate the data required to automatically control the drive means to point the antenna to each of said satellites, means to control the drive means to automatically peak the antenna for maximum signal strength at each antenna position in both the azimuth and elevation directions including means to sense signal strength, means to rotate the signal pickup means to a signal null, and means to rotate the signal pickup means 90° from the null.

2. The device of claim 1 wherein the peaking means is under operator control.

3. The device of claim 1 further comprising means to rotate the signal pickup means to change from horizontal polarity to vertical polarity, the receiver further comprising means to control the rotating means to automatically peak the signal pickup means for maximum signal strength at each antenna position.

4. The device of claim 3 wherein the signal rotating peaking means is under operator control.

5. The device of claim 4 further comprising a remote control, all functions under operator control being controllable with said remote control.

6. The device of claim 3 wherein the signal pickup peaking means has means to minimize skew.

7. The device of claim 1 wherein the antenna drive means comprises a motor for each of the azimuth and elevation directions, and a gear reduction means associated with each motor, each gear reduction means being entirely comprised of a plurality of substantially circular gears.

8. The device of claim 7 wherein the gear reduction means utilize non-worm gears.

9. The device of claim 7 wherein the gear reduction means exclusively utilize spur gears.

10. The device of claim 7 wherein the gears are injection molded plastic.

11. The device of claim 1 further comprising means to determine the directional orientation of the antenna, and means to communicate said orientation data to the receiver.

12. The device of claim 1 wherein the receiver further comprises means to store the antenna positions corresponding to maximum signal strength, and means to automatically control the drive means to move the antenna into said antenna positions upon operator command.

13. The device of claim 12 wherein the receiver further comprises means to repeat the peaking and store the antenna positions determined in said repeated peaking.

14. The device of claim 1 wherein the peaking means comprises means to sense signal strength, means to scan the antenna through a pre-determined arc, and means to select that position in the arc corresponding to maximum signal strength.

15. A programmable controller for a satellite television reception only antenna, the antenna having means to receive signals broadcast from a plurality of satellites in geo-synchronous orbits over the equator, the antenna comprising a dish, means mounting the dish to a support, a signal pickup means and means to drive the dish in the azimuth and elevation directions to point it at one of said satellites, the controller having means to control the drive means, means for an operator to program the controller by initializing the antenna and entering data corresponding to the geographic location of the antenna, means to calculate the data required to automatically control the drive means to point the antenna to each of said satellites, means to control the drive means to automatically peak the antenna for maximum signal strength at each antenna position in both the azimuth and elevation directions including means to sense signal strength, means to rotate the signal pickup means to a signal null, and means to rotate the signal pickup means 90° from the null.

16. The device of claim 15 further comprising means to rotate the signal pickup means to change from horizontal polarity to vertical polarity, the receiver further comprising means to control the rotating means to automatically peak the signal pickup means for maximum signal strength at each antenna position.

17. The device of claim 16 wherein the antenna drive means comprises a motor for each of the azimuth and elevation directions, and a gear reduction means associated with each motor, each gear reduction means being entirely comprised of a plurality of substantially circular gears.

18. The device of claim 17 wherein the gear reduction means exclusively utilize spur gears.

19. The device of claim 18 further comprising means to determine the directional orientation of the antenna, and means to communicate said orientation data to the receiver.

20. An antenna for a satellite television receiver, said antenna having means to drive it in the azimuth and elevation directions, said drive means comprising an azimuth drive motor and associated gear means and an elevation drive motor and associated gear means, each of said gear means being comprised of a plurality of gears, said gears being only circular or spur gears and means to detect and measure the rotational movement of each of said gear means.

21. The device of claim 20 wherein at least one of said gear means has an output gear and further comprising means to mechanically limit the travel of said output gear to thereby limit the travel of said antenna.

22. The device of claim 21 wherein the output gear is in the azimuth gear means.

23. The device of claim 20 wherein each of said gear means has means to minimize gear backlash and slippage.

24. The device of claim 23 wherein said gear backlash and slippage minimizing means comprises sufficiently large reduction ratios between the gears comprising each of said gear means.

* * * * *